US005400763A

United States Patent [19]

Mazza

[11] Patent Number: 5,400,763

[45] Date of Patent: Mar. 28, 1995

[54] ARROW REST FOR ARCHERY BOWS

[76] Inventor: Victor Mazza, P.O. Box 364, Dixon, Mo. 65459

[21] Appl. No.: 286,554

[22] Filed: Jan. 10, 1994

Related U.S. Application Data

[63] Continuation-in-part of Ser. No. 897,393, Jun. 12, 1992, abandoned.

[51] Int. Cl.[6] ..... F41B 5/00

[52] U.S. Cl. ..... 124/44.5; 124/24.1

[58] Field of Search ..... 124/44.5, 24.1

[56] References Cited

U.S. PATENT DOCUMENTS

| | | | |
|---|---|---|---|
| 3,865,096 | 2/1975 | Troncoso, Jr. . | |
| 3,935,854 | 2/1976 | Troncoso, Jr. . | |
| 4,332,232 | 6/1982 | Troncoso, Jr. . | |
| 4,398,528 | 8/1983 | Troncoso, Jr. . | |
| 4,489,704 | 12/1984 | Trocoso, Jr. . | |
| 4,686,956 | 8/1987 | Troncoso, Jr. | 124/44.5 |
| 4,838,237 | 6/1989 | Cliburn . | |
| 5,065,731 | 11/1991 | Smith | 124/44.5 |
| 5,095,884 | 3/1992 | Mertens | 124/44.5 |
| 5,117,803 | 6/1992 | Johnson | 124/44.5 |
| 5,144,937 | 9/1992 | Colvin | 124/44.5 |

*Primary Examiner*—Randolph A. Reese
*Assistant Examiner*—Anthony Knight
*Attorney, Agent, or Firm*—Kokjer, Kircher, Bowman & Johnson

[57] ABSTRACT

An arrow rest for archery bows which includes a mounting bracket which may be fixed to the bow. The mounting bracket may be of an extended rearward length, such that the arrow rest may be employed with arrows having a shorter length. The mounting bracket supports a pivot cylinder for rotation therein. Mounted about the pivot cylinder is a support collar which may be adjusted circumferentially and longitudinally of the cylinder. The collar mounts a pair of arrow supports which are elongated and extend outward toward free ends. Adjustment means are provided to vary the distance between the free ends for different arrow types. A coil spring is located within the cylinder and is fixed to one end thereof. The mechanism for fixing the spring to the cylinder may also function as a limit on the rotation of the cylinder. An adjustment member is releasably fixed to the mounting bracket and extends into the cylinder. The second end of the coil spring is fixed to the adjustment member, such that relative rotation between the adjustment member and the cylinder will place different torsional forces upon the coil spring which are transferred to the cylinder. This allows adjustment of the force required to deflect the arrow support members.

11 Claims, 2 Drawing Sheets

ARROW REST FOR ARCHERY BOWS

This is a continuation-in-part of application Ser. No. 07/897,393, filed Jun. 12, 1992, now abandoned.

BACKGROUND OF THE INVENTION

1. Field of the Invention

The present invention relates in general to bows for archery and hunting. In particular, the present invention relates to an improved arrow rest for use with such bows.

2. Description of the Related Art

Archery bows of the long bow, re-curve, compound and other types typically include a handle, above which is located a shelf and side wall. The shelf and side wall cooperate to define a window within which the arrow rests and is ejected from the bow. To minimize the deflection of the arrow as it passes through this window, and to thus improve the accuracy of the bow, various spring biased arrow rests have been proposed. Examples of such rests are shown in U.S. Pat. Nos. 3,865,096, 3,935,854, 4,332,232, 4,398,528, 4,489,704 and 4,838,237.

While such devices are serviceable, they typically include a biasing means in the form of an exterior spring to allow the arrow support members to deflect away from the arrow. The exterior placement of such springs allows them to be open to the elements and deterioration, and also posses the possibility of foreign objects such as stones or clothing will become lodged within the coils of the springs, interfering with the deflection of the support members.

One commercially available arrow rest is known to avoid the exterior placement of the spring. In this arrangement the arrow support members are mounted on a shaft which is received within a cylinder. The other end of this cylinder is mounted for rotation within a bracket. A coil spring is mounted on the exterior of the cylinder and within a receiving hole in the bracket, and includes one end fixed to the cylinder and a second end fixed to the bracket. While this arrangement provides a shelter for the spring, the cylinder receiving hole in the mounting bracket and the cylinder itself define limits upon the amount of change in the spring diameter caused by torsion. This limits the range of pressure which may be applied to the arrow support members.

Another problem associated with previous arrow rests is the cantilevered nature of the cylinder or other rotary element which carry the arrow support members. This cantilevered arrangement causes the weight of the arrow, arrow support members and cylinder to create a moment force at the single rotary connection of the cylinder to the mounting bracket of the rest. Such a moment is perpendicular to the axis of rotation of the cylinder, and as such causes a certain amount of binding in the rotation. This binding amount changes with wear upon the rotary connection, such that the arrow support members require a different force for movement, even at the same tension setting.

Additionally, various arrow support members have been proposed, and examples are shown in the above noted patents. However, it would be desirable to provide arrow support members which may be easily and reliably adjusted to various positions for different arrow types.

SUMMARY OF THE INVENTION

An object of the present invention is to provide an arrow rest having biased arrow support members in which the biasing spring is sheltered, yet may apply a wide range of pressures.

Another object of the present invention is to provide an arrow rest which will allow a wide variety of adjustment for different arrow sizes, types and weights.

Yet another object of the present invention is to provide such an arrow rest which may be employed with arrows of shorter length.

A further object of the present invention is to provide an arrow rest in which two spaced pivotal elements are provided to avoid a cantilevered arrangement of the cylinder.

Yet a further object of the present invention is to provide arrow support members which may be adjusted for various arrow support configurations.

These and other objects are achieved by an arrow rest for archery bows which includes a mounting bracket which may be fixed to the bow. The mounting bracket may be of an extended rearward length, known among archers as an "overdraw" such that the arrow rest may be employed with arrows having a shorter length. The mounting bracket supports a pivot cylinder for rotation therein. Mounted about the pivot cylinder is a support collar which may be adjusted circumferentially and longitudinally of the cylinder. The collar mounts a pair of arrow supports which are elongated and extend outward toward free ends. Adjustment means are provided to vary the distance between the free ends for different arrow types. A coil spring is located within the cylinder and is fixed to one end thereof. The mechanism for fixing the spring to the cylinder may also function as a limit on the rotation of the cylinder. An adjustment member is releasably fixed to the mounting bracket and extends into the cylinder. The second end of the coil spring is fixed to the adjustment member, such that relative rotation between the adjustment member and the cylinder will place different torsional forces upon the coil spring which are transferred to the cylinder. This allows adjustment of the force required to deflect the arrow support members.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
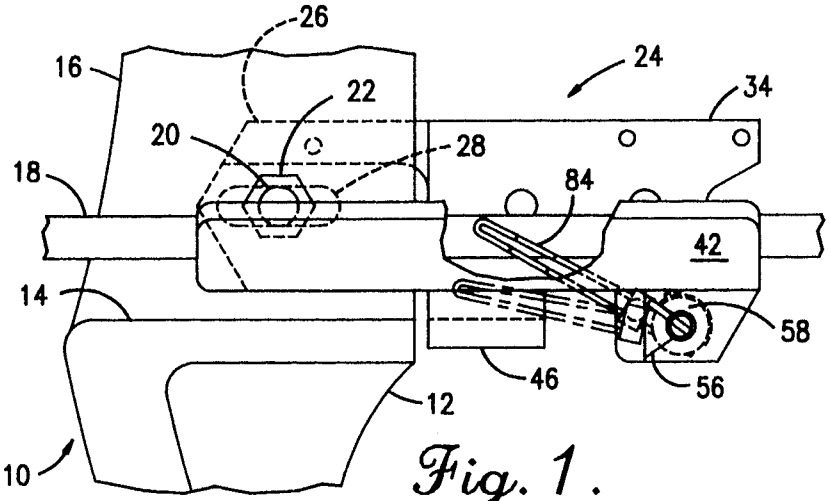
FIG. 1 is a left side view of a first embodiment according to the present invention.

With reference to FIG. 1, a typical bow with which the present invention is employed is generally designated by reference numeral 10. The bow 10 will include a handle grip 12 with which the user grasps the bow. Above this handle grip is located a shelf 14, and extending upwardly from the shelf is a sidewall or riser 16. The sidewall 16 and shelf 14 cooperate to define a window through which an arrow, the shaft of which is designated by numeral 18, may pass. In particular, with reference to FIG. 1 the arrow will be ejected from the bow towards the left. The sidewall 16 includes a mounting hole 20 therethrough, which may include a hexagonal depression for receipt of a mounting nut 22.

A first embodiment of the device is generally indicated in FIG. 1 by reference numeral 24. The device includes a mounting bracket 26 which is adapted to abut against the riser 16 on the face thereof opposite the shelf 14. The mounting bracket includes an elongated slot 28 which may receive a mounting bolt 30. The mounting bolt will be engaged with the mounting nut 22 to maintain the bracket 26 in a fixed position against the riser, with the slot 28 allowing the mounting bracket to be moved forward and rearward with respect to the riser.

Securely mounted to the mounting bracket 26 is a pivot support. The pivot support includes a lateral spacer 32 extending from the rear of the mounting bracket to a position just adjacent the open "window" of the bow. A first side member 34 extends rearward from the innermost end of the lateral spacer 32. Adjacent the rear lower corner of the side member 34 there is formed a pivot block 36 (FIG. 6), typically having a width greater than that of side member 34. A second pivot block 38 (FIG. 6) is maintained in a laterally spaced position from the first pivot block by a lateral frame member 40.

Figure 6:
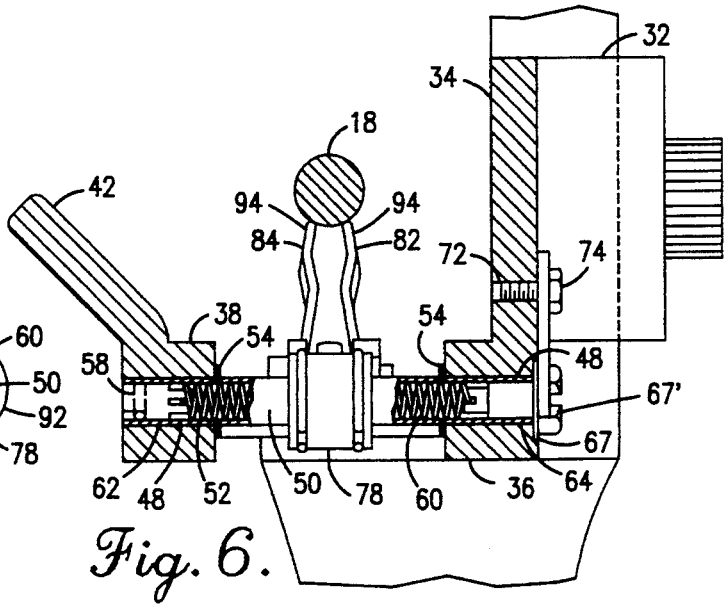
FIG. 6 is a cross sectional view along line 6—6 of FIG. 5.

Although not strictly necessary for operation, there may also be provided a second side member 42 extending substantially parallel to the first side member 34. The second side member may be angled laterally outward, as is best shown in FIG. 6. The provision of the side members forms a general tray-like configuration for the device, such that the arrow may be maintained within the device should it fall from the proper position for shooting. This will reduce the time necessary to move the arrow back into the proper position for shooting. The device my also include a laterally extending limit stop 46 between the side members 34 and 42. The purpose of the limit stop will be discussed below.

Each of the pivot blocks 36 and 38 includes a through-hole 48, with these holes being coaxial. A pivot cylinder 50 is rotatably received within the through holes 48 and has a length substantially corresponding to the width of the two pivot blocks, as is best shown in FIG. 6. The provision of the laterally spacing between two pivot blocks provides improved support for the cylinder 50, and ensures that it will rotate smoothly. This is believed to be in contrast with other arrow rests which cantilever elements from a single rotation support, which can cause binding and undue wear due to the moment applied to the single rotation support by the weight of the arrow and cantilevered elements. In the present invention there is no similar moment applied due to the spaced support blocks, and thus greatly reduced binding and wear.

Peripheral grooves 52 are formed on the exterior of the cylinder, with one groove 52 laterally inward of each of the pivot blocks 36 and 38. A C-Clip 54 is seated in each of the grooves 52 such that the cylinder 50 is fixed against translation along its longitudinal axis.

The second pivot block 38 includes, on its laterally exterior face, an abutment cut out 56. The cut out 56 has the general shape of a wedge, with abutment faces extending radially outward from the longitudinal axis of the cylinder 50. An abutment pin 58 extends radially outward from the cylinder 50 in proximity to a second end of the pivot cylinder, such that the abutment pin is located within the abutment cut out 56. The abutment pin may advantageously be formed as a length of thin metal rod fixed within diametrically opposed holes in the periphery of the pivot cylinder. The abutment pin in combination with the abutment cut out will thus define the limits for pivotal movement of the pivot cylinder.

While the pivot cylinder may rotate between the limits defined by the abutment pin and cut out, it is provided with means for biasing in a clockwise direction with respect to FIG. 1. This means for biasing preferably takes the form of a coil spring 60 located within the pivot cylinder 50.

Figure 4:
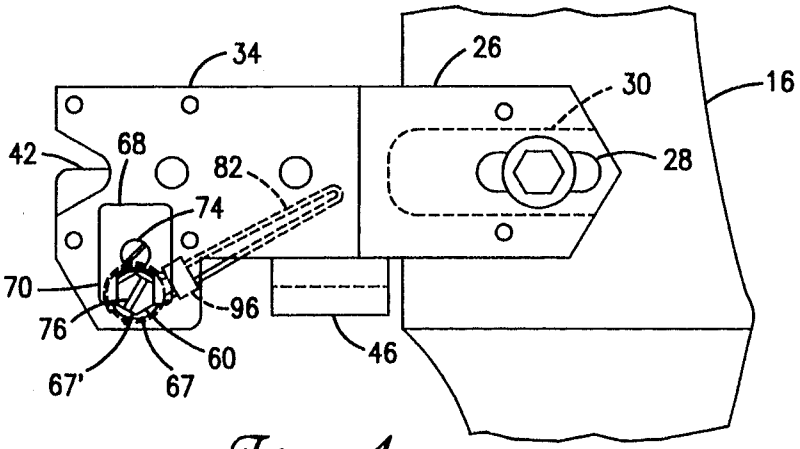
FIG. 4 is a right side view of the embodiment of FIG. 1.

In particular, a spring catch 62 is located within cylinder 50 adjacent the abutment pin 58. The spring catch 62 includes a slot extending into each longitudinal end, with one of the slots receiving the abutment pin 58, and the other of the slots receiving an end of the coil spring 60. As such, this end of the coil spring is fixed with respect to pivot cylinder 50. The other end of the coil spring is received within a slot formed in a first end of an adjustment stud 64. The adjustment stud is slidingly received within the pivot cylinder 50, and a second end of the adjustment stud, opposite the slot, includes an enlarged faceted head 66. The head 66 includes a flange 67 having a diameter greater than that of the pivot cylinder, and preferably received within a shallow recess in the exterior face of the pivot block (see FIG. 6). The head 66 further includes a faceted portion 67' which may take the common form of a hexagon. It is noted that the flange 67 extends outward beyond the faceted portion, as best shown in FIG. 4.

The faceted head, and thus the adjustment stud, are fixed against rotation by use of a stud collar 68 which may be fixed to the side member at 34. The stud collar 68 includes at least one, and preferably two tines 70 expending outwardly therefrom which may engage one or more of the facets of the faceted head 66, as is best shown in FIG. 4. As may be seen by comparison of FIGS. 4 and 6, the flange 67 will prevent movement of the stud 64 inward by abutment against the pivot block, and will prevent movement of the adjustment stud outward by abutment against the tines 70.

To allow rotation of the adjustment stud 64, and thus adjustment of the tension in the spring 60 as described below, the stud collar 68 must be removably mounted upon the side member 34. To this end the stud collar may be provided with an opening which may be aligned with a threaded hole 72 in the side member 34. An adjustment bolt 74 will extend through this opening and engage with the hole 72 to fix the stud collar in place. Removal of the bolt 74 will allow the stud collar to be removed and the faceted head 66 rotated. To assist in this rotation of the faceted head, a slot 76, as for a standard screwdriver, may be formed in the faceted head 66. It is noted that upon removal of the collar the stud will be free to rotate and to move outward, as the abutments against such movement are provided by the collar. As such, it is necessary to manually prevent such movement during the time the collar is removed.

With this arrangement the coil spring 60 is fixed with resect to the pivot cylinder by use of the spring catch 62, and the opposite end of spring 50 is fixed with respect to the side member by use of the adjustment stud 64 and stud collar 68. With this arrangement rotation of the cylinder 50 with respect to the side member 34 will place the coil spring 60 in torsion, thus causing an increasing spring force to develop with increased rotation. As noted above, the cylinder 50 is typically adjusted to provide an initial bias in a clockwise direction against the abutment cut out 56, such that rotation in a counter clockwise direction, with respect to FIG. 1, will cause the increasing spring force.

As the coil spring 60 is located within the cylinder 50, this cylinder defines an outer limit to the diameter of spring 60. As the spring may tend to increase its diameter when placed in torsion in a direction opposite to its direction of coil, it is preferred that the direction of coil for spring 60 correspond to the direction of increasing spring force, or counter clockwise with reference to FIG. 1. With this arrangement the rotation of the cylinder 50 in the desired direction for operation of the device will provide an increasing spring load as desired, with the diameter of coil spring 60 being reduced.

This arrangement has an advantageous effect upon the adjustment of the spring tension exerted upon the cylinder 50. Specifically, rotation of the adjustment stud 64 in the clockwise direction (with reference to FIG. 1) will place the spring 60 under torsion prior to movement from the solid line position. In this manner the spring force applied to the cylinder 50 may be adjusted. However, it is noted that with adjustment for increased spring force the diameter of the coil spring 60 will grow smaller. Rotation of the cylinder during operation will cause the spring force to increase and the spring diameter to be further reduced. In the present device, however, there is nothing to prevent such a reduction in diameter, and the only limit to the amount of spring force which may be generated is the elastic limit of the spring 60. This allows the biasing means of the present invention to provide a wide range of loading characteristics. Additionally, the laterally spaced pivot blocks, as noted above, prevent binding of the rotary joints, such that the spring force is reliably maintained and adjusted.

Connected to the pivot cylinder 50 is a means for supporting the arrow shaft 18. This means includes a finger collar 78 formed as an annulus and which receives the pivot cylinder 50 therethrough. The finger collar 78 is fixed in place upon the cylinder 50 by means of a set screw 80 threaded through the finger collar. Loosening of the set screw will allow the collar to be moved both circumferentially and longitudinally of the cylinder 50. Extending outwardly from the finger collar 78 are finger elements 82 and 84. The finger elements have free ends which contact and support the arrow shaft 18 in a manner known in the art.

Figure 5:
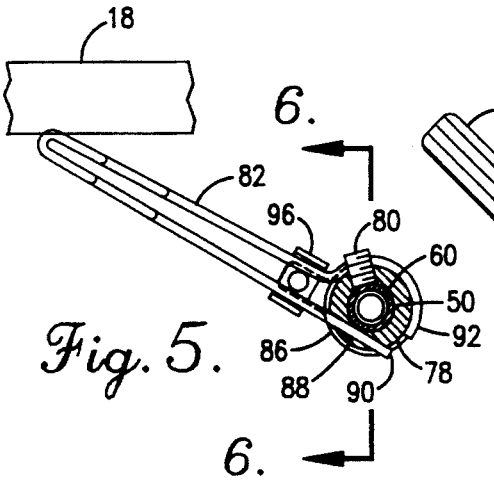
FIG. 5 is a cross sectional view along line 5—5 of FIG. 3.

The finger elements 82 and 84 are preferably formed as wire elements. The connection of each finger element to the finger collar 78 may be effected by a peripheral groove 86 on the finger collar and an opening passing through the finger collar along a chord of its annulus. As is best shown in FIG. 5, the chord of the annulus formed by the opening does not pass through the cylinder 50. The finger elements each include a bend near the middle of the wire of which they are formed, with this bend defining the free end of the element. The opposite two ends of each finger element has a straight portion 90 and a curved portion 92. The straight portion 90 may be inserted through the associated opening 88, while the bend at the free end and the resilient nature of the finger element allows the curved portion 92 to be elastically bent upwardly and over the finger collar 78 until the curved portion rests within the peripheral groove 86.

With this arrangement the finger elements may be replaceable, but are firmly held in place upon the finger collar 78. As noted above, the set screw 80 may be loosened such that the finger collar 78 may be moved with respect to the cylinder, and this movement will allow the free ends of the finger elements to be placed in the desired position. The set screw may thereafter be tightened to fix to finger elements in this desired position.

Figure 2:
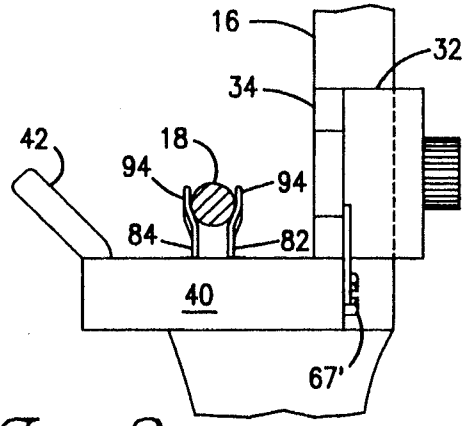
FIG. 2 is a rear view of the embodiment of FIG. 1.

As is best shown by comparison of FIGS. 2 and 6, the free ends of the finger elements preferably include mirror image dog legs 94 such that the free ends are offset laterally exterior to the remainder of each finger element. Each of the finger elements 82 may then be provided with an adjustment bracket 96 spaced from the free ends, with one of the adjustment brackets having a threaded hole therethrough. The other adjustment bracket 96 will have a simple through hole, such that an adjustment screw may be freely inserted through this adjustment bracket and threaded into the other adjustment bracket. With this arrangement the distance between the free ends of the finger elements may be adjusted by rotation of adjustment screw 98. This arrangement, in combination with the dog legs 94, allows the finger elements to be brought into proximity such that the arrow shaft 18 rests upon the tips of the free ends of the finger elements, as shown in FIG. 6, or allows the free ends to be spaced apart such that the shaft of the arrow is cradled between the dog legs, as shown in FIG. 2. The resilient nature of the wire forming the finger elements ensures that loosening of the screw 96 will cause expansion of the space between the free ends.

To assist in maintaining the alignment of the finger elements, and to provide a common finger collar for use with a second embodiment described below, it is preferred that the finger collar 78 include a lug 100 extending radially outward therefrom and including a opening through which the adjustment screw 98 may freely pass.

Figure 3:
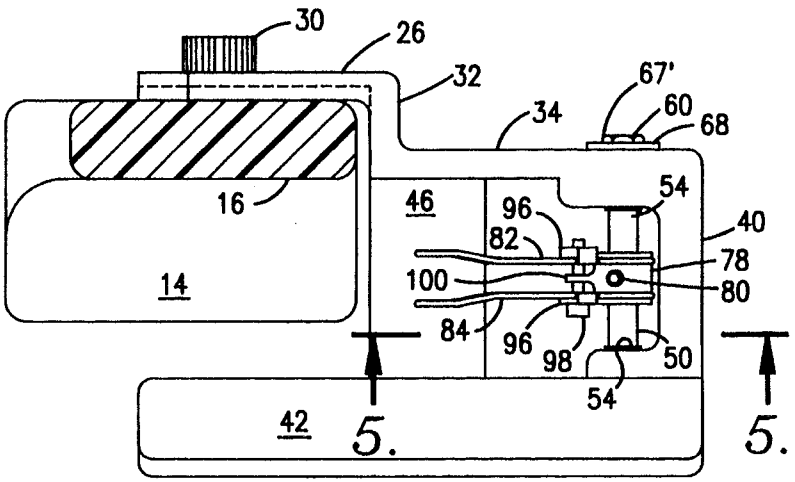
FIG. 3 is a top view of the embodiment of FIG. 1.

As is best shown in FIGS. 1, 3 and 4, the length of the mounting bracket 26 and side member 34 are such that the pivot cylinder 50 is located well behind the riser 16. As such, the tips of the finger elements 82 and 84, whether they receive the arrow shaft therebetween as shown in FIG. 2, or support the arrow shaft from below as shown in FIG. 6, are additionally spaced behind the riser 16. This allows the arrow rest according to the present invention to be employed with arrows having shortened shafts.

As is best shown in FIG. 1, the limit stop 46 will prevent counter clockwise rotation (with respect to FIG. 1) of the finger elements due to its placement. The placement of the limit stop 46 is, of course, configured to allow a sufficient amount of rotation for the finger elements to rotate downward to allow the arrow to cleanly pass above the finger elements as is desired in an arrow rest of this type.

A second embodiment according to the present invention is shown in FIGS. 7–10. This embodiment is similar in its gross characteristics to the first embodiment, with the major differences being the elimination of the lateral spacer 32 and the side members 34 and 42. In this embodiment, the mounting bracket 26 extends rearward of the riser a slightly greater distance and is connected directly to the first pivot block 36. It is noted that even in this embodiment the pivot blocks are laterally spaced to provide two support points for the cylinder, aiding in smooth rotation.

To allow additional adjustment of the bracket of the second embodiment, it is preferred that the connection between the mounting bracket and the first pivot block be made by way of screws 104 which pass through vertically elongated adjustment slots 106 in the mounting bracket 24 and are engaged with threaded holes (not shown) in the first pivot block 36. This will allow the pivot block, and thus the pivot cylinder 50, to be moved in a vertical direction for adjustment relative to mounting bracket 26, and thus the bow.

Figure 10:
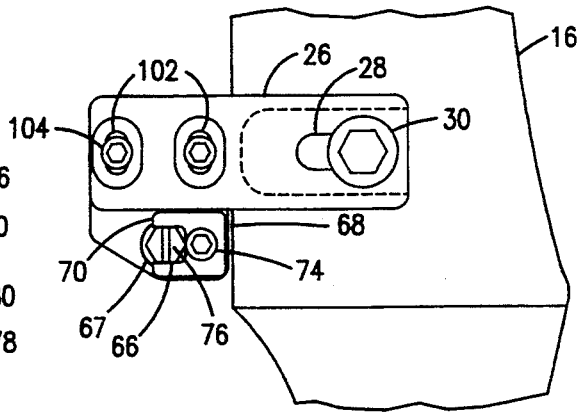
FIG. 10 is a right view of the embodiment of FIG. 7.

As is best shown in FIG. 10, the vertical adjustment of the pivot block makes it preferable to mount the stud collar 68 such that the bolt 74 is located forward of the faceted head 66, with the tines 70 extending rearward. This reduces the vertical extent of the stud collar 68, allowing further vertical adjustment compared to the arrangement of collar 68 in the first embodiment.

A second modification in this second embodiment is the formation of the finger elements 82 and 84. In this embodiment, the finger element 82 is formed as in the previous embodiment, but the finger element 84 is bent laterally at a position spaced just below its free end to form an arrow ledge 108 as is best seen from in FIGS. 7 and 8. When the finger elements are located to their uppermost position (or slightly below this uppermost position due to the weight of an arrow resting thereupon) the ledge 108 will form a substantially horizontal plane to support the arrow shaft 18. In this arrangement, the tip of the finger element 82 will provide little if any support for the weight of the arrow shaft, but will act as a lateral stop and guide to aide in maintaining the arrow shaft upon the ledge 108.

Figure 9:
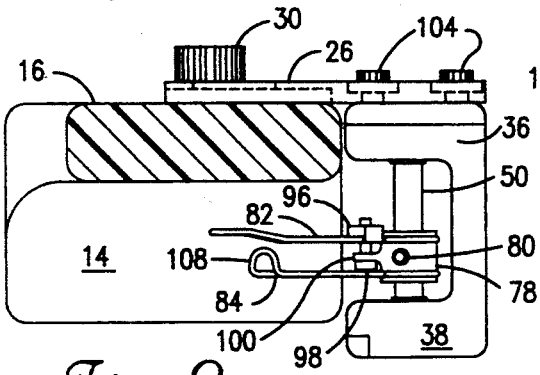
FIG. 9 is a top view of the embodiment of FIG. 7.

As in the previous embodiment, it is preferred that the finger elements be provided with means for lateral adjustment there between. As the ledge 108 could be moved out of its preferred horizontal position by the adjustment described in the first embodiment, it is preferred that only the finger element 82 be provided with this lateral adjustment. As is best shown in FIG. 9, the finger element 82 is provided with an adjustment bracket 96 as in the previous embodiment. However, the adjustment screw 98 passes only through the opening of lug 100 and the threaded hold in bracket 96, with the head of screw 98 being accessible between the wire forming the finger element 84. With this arrangement the lug 100 will allow the finger element 82 to be moved laterally toward and away from the finger element 84. As with the first embodiment, this movement is facilitated by the resilient nature of the wire used to form the finger elements.

Figure 7:
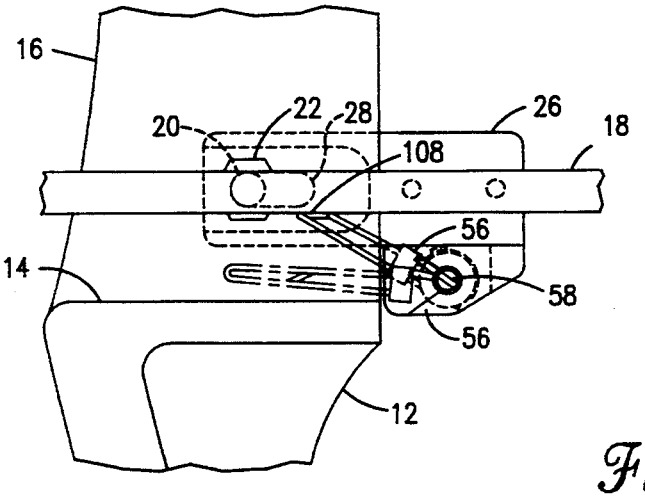
FIG. 7 is a left side view of a second embodiment according to the present invention.
Figure 8:
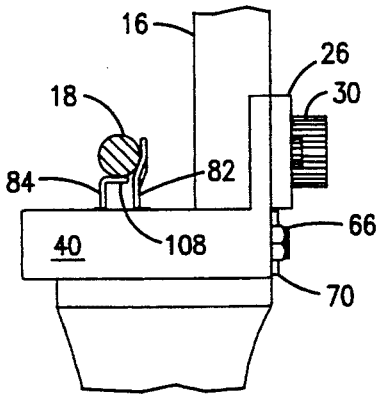
FIG. 8 is a rear view of the embodiment of FIG. 7.

As is best shown in FIG. 7, the pivot cylinder, and thus the free ends of the finger elements are located in close proximity to the bolt hole 20 in the riser 16. As such, this embodiment of the present invention may be employed with arrows having a standard shaft length.

While the present invention has been described above with regard to specific embodiments, it should be apparent to those skilled in the art that variations are possible without departing from the scope of the invention. For example, the finger element 84 having the ledge 108 could be employed with the first embodiment, or the second embodiment could be provided with elements equivalent to the side members to define a tray-like configuration as in the first embodiment.

From the foregoing it will be seen that this invention is one well adapted to attain all ends and objects hereinabove set forth together with the other advantages which are obvious and which are inherent to the structure.

It will be understood that certain features and sub-combinations are of utility and may be employed without reference to other features and sub-combinations. This is contemplated by and is within the scope of the claims.

Since many embodiments may be made of the invention without departing from the scope thereof, it is to be understood that all matter herein set forth or shown in the drawings is to be interpreted as illustrative, and not in a limiting sense.

What is claimed is:

1. An arrow rest for archery bows, comprising:

a mounting bracket adapted to be fixed to a riser of the bow;

at least one pivot block supported by said mounting bracket, said pivot block including a hole therethrough and at least one abutment surface;

a pivot cylinder extending into said hole and being mounted for rotation about the longitudinal axis of said cylinder, yet fixed against translation with respect to said pivot block;

an abutment member extending from said cylinder and adapted to abut against said abutment surface, thereby limiting said rotation of said cylinder;

an adjustment stud extending into said cylinder a distance less than the length of said cylinder, said stud being rotatable with respect to said cylinder;

a stud collar connected to said pivot block and releasably fixing said stud against rotation with respect to said pivot block; and a coil spring mounted in said cylinder, a first end of said spring being fixed to said cylinder and a second end of said spring being fixed to said stud; and at least one finger element extending from said cylinder and adapted to support an arrow.

2. A rest as in claim 1, wherein said cylinder, and thus said finger element, rotate in a clockwise direction to operatively deflect away from the arrow when ejected, and said coil spring is oriented such that said torsion placed upon the spring by said cylinder rotating in said direction will tend to reduce the diameter of said coil spring.

3. A rest as in claim 2, wherein the only limit to such torsion-induced reduction in said spring diameter is the elastic limit of said spring.

4. A rest as in claim 3, wherein said at least one pivot block comprises two spaced pivot blocks, each having said hole therethrough and rotatably mounting said cylinder, said finger elements being located intermediate said blocks.

5. A rest as in claim 3, further including a collar mounted on said cylinder for sliding and rotation thereon, said collar mounting said finger element, and a set screw for fixing said collar in a desired position on said cylinder.

6. A rest as in claim 5, wherein said finger element is removably mounted on said collar.

7. A rest as in claim 6, wherein said at least one finger element comprises two finger elements.

8. A rest as in claim 7, wherein said finger elements include free ends, and each of said finger elements includes a laterally outward dogleg adjacent and including said free end.

9. A rest as in claim 8, further including means for adjusting the distance between said finger elements.

10. A rest as in claim 7, wherein said finger elements include free ends, and one of said finger elements includes a laterally outward dogleg adjacent and including said free end, and the other of said finger elements includes a substantially horizontal ledge adjacent and including said free end.

11. A rest as in claim 10, further including means for adjusting the distance between said finger elements.

* * * * *